US007093408B2

(12) United States Patent
Duperray et al.

(10) Patent No.: US 7,093,408 B2
(45) Date of Patent: Aug. 22, 2006

(54) PACKAGING MACHINE AND METHOD OF FORMING A CARTON

(75) Inventors: Philippe Duperray, Chateauroux (FR); Joel Mennetrat, Chateauroux (FR); Pierre Genty, Chateauroux (FR)

(73) Assignee: Meadwestvaco Packaging Systems, LLC, Stamford, CT (US)

( * ) Notice: Subject to any disclaimer, the term of this patent is extended or adjusted under 35 U.S.C. 154(b) by 0 days.

(21) Appl. No.: 10/012,636

(22) Filed: Nov. 13, 2001

(65) Prior Publication Data

US 2002/0083680 A1 Jul. 4, 2002

Related U.S. Application Data

(63) Continuation of application No. PCT/US00/12951, filed on May 12, 2000.

(30) Foreign Application Priority Data

May 12, 1999 (GB) ..... 9911092.6

(51) Int. Cl.
*B65B 21/00* (2006.01)

(52) U.S. Cl. ..... 53/398; 53/48.1; 53/242; 53/246; 53/539; 53/543

(58) Field of Classification Search ..... 53/398, 53/48.1, 49, 242, 246, 539, 543
See application file for complete search history.

(56) References Cited

U.S. PATENT DOCUMENTS

| | | | | | |
|---|---|---|---|---|---|
| 3,763,750 | A | | 10/1973 | Reichert | |
| 3,940,907 | A | * | 3/1976 | Ganz | 53/48.1 |
| 4,023,328 | A | * | 5/1977 | Calvert et al. | 53/157 |
| 4,544,368 | A | | 10/1985 | Labombarde | |
| 5,626,002 | A | * | 5/1997 | Ford et al. | 53/398 |
| 5,671,587 | A | * | 9/1997 | Robinson | 53/398 |

FOREIGN PATENT DOCUMENTS

| | | |
|---|---|---|
| EP | 0 012 610 | 6/1980 |
| WO | WO 98/52826 | 11/1998 |
| WO | WO 99/14122 | 3/1999 |
| WO | WO 99/14123 | 3/1999 |
| WO | WO 99/14126 | 3/1999 |
| WO | WO 99/14127 | 3/1999 |

* cited by examiner

*Primary Examiner*—Eugene Kim
*Assistant Examiner*—Christopher Harmon

(57) ABSTRACT

An apparatus for regulating the flow of articles from an infeed stream at an infeed end of a packaging machine which apparatus comprises a plurality of article feed lanes for supplying a row of articles converging at a predetermined position, each feed lane having a regulator to control article flow, one of said regulators providing a reference position by which the relative positions of the articles may be controlled such that as the lanes converge one row of articles is offset from the or each other rows of articles.

16 Claims, 9 Drawing Sheets

PACKAGING MACHINE AND METHOD OF FORMING A CARTON

CROSS-REFERENCE TO RELATED APPLICATIONS

This is a continuation of international application No. PCT/US00/12951, filed May 12, 2000, which is pending at the time of filing hereof, and which international application claims priority based upon GB patent application serial number 9911092.6, filed May 12, 1999.

BACKGROUND OF THE INVENTION

This invention relates to packaging a primary article such as cans or bottles in multiple packaged cartons and is more particularly concerned with feeding such cartons in collapsed condition from a hopper, and for initiating and then completing a set of operation of cartons in sequence.

One common method used by known packaging machines typically comprises moving a collapsed carton from the suppliers of such cartons or blanks. The collapsed carton is then erected, and the cans, bottles or other articles to be packaged are placed in the erected carton. Alternatively, a supplier of cartons in the form of flat blanks may be provided. After withdrawal of the carton from the supply, a carton may first be partially formed and is then placed on to the articles. The carton is further formed into the completed package.

The majority of known packaging machines are dedicated machines which construct only one size of carton. Therefore, modern bottling plants are required to use a plurality of packaging machines to package different carton types, each machine taking up considerable floor space and being expensive to purchase and operate.

However, a limited number of packaging machines are capable of packaging different sizes or types of carton, for example six, eight or twelve packs of a wrap around carton. All such machines require adjustment when switching from one size or type of carton to another. This adjustment includes the manual removal of all of the cartons within the packaging machine and possibly the mechanical adjustment of components in the machine. During this change over period, which can be thirty minutes or more, a machine cannot be used (known as "down time"), which is an expensive delay in a bottling plant. Such a delay may even result in down time for the entire bottling line, not just the packaging machine, if problems arise during the change over procedure.

WO 98/52826 illustrates a carton set up machine having a suction device for withdrawing collapsed basket type cartons from a hopper or magazine parallel to, but offset from the longitudinal axis of the machine. The blanks are stored with their bottom panel lowermost and are rotated about a substantially vertical axis to be transferred from the magazine to the feed of the machine. The cartons are then engaged by the handle panel to progress through the first stage of the erecting process.

The off-set nature of the hopper means that the machine requires more floor space, and the fact that the blanks must be stacked on their bottom flaps weakens the stack, and may lead to feed and subsequent construction problems.

Pending PCT applications PCT/US98/19523, PCT/US98/19646, PCT/US98/196512, PCT/US98/19619 disclose a machine switchable "on the fly" between basket, fully enclosed and wraparound carton types. However, the supply hoppers feed at right angles to the direction of the carton erection process.

BRIEF SUMMARY OF THE INVENTION

The present invention seeks to overcome or at least mitigate the problems of the prior art.

One aspect of the present invention provides an apparatus for sequentially manipulating out of a hopper and initiating set up of collapsed cartons having oppositely disposed side and end panels and a pair of panels for forming a base, said apparatus comprising a carton pick up device for sequentially engaging one of said opposed panels and for withdrawing from the hopper a collapsed carton, a feeder for transferring said carton from said hopper to an in-feed end of the packaging machine, a separator to separate the base panels to cause one of said base panels to be engaged by a conveyor, a guide to manipulate or to guide the side and end panels into a substantially vertical plane, and a carton erecting device for separating the opposing side and end panels to erect the carton.

According to an optional feature of this aspect of the invention, the feeder may be a rotary feeder having the carton pick up device mounted thereon.

According to a further optional feature of this aspect of the invention, the separator may comprise a fixed guide which engages one of said base panels and folds it out of the plane of the carton.

According to a yet further optional feature of this aspect of the invention, the guide may be a second fixed guide.

According to a still optional feature of this aspect of the invention, the carton erecting device may comprise a vacuum suction cup rotatably mounted on a drive shaft such that the suction cup may move under guided linear motion towards and away from the carton during one complete rotation of the drive shaft.

A second aspect of the invention provides an apparatus for regulating the flow of articles from an infeed stream at an infeed end of a packaging machine which apparatus comprises a plurality of article feed lanes for supplying a row of articles converging at a predetermined position, each feed lane having a regulator to control article flow, one of said regulators providing a reference position by which the relative positions of the articles may be controlled such that as the lanes converge one row of articles is offset from the or each other rows of articles.

According to an optional feature of this aspect of the invention, the apparatus may further comprise a grouping mechanism for grouping at least one article, and spacing said article group from the next succeeding article group.

Preferably, a further regulator may be provided downstream of the convergence position to feed the correct number of articles into said grouping mechanism.

More preferably, the apparatus may comprise control means to control the operation of each of the regulators and said article grouping mechanism during operation and changeover between cartons.

A third aspect of the invention provides a packaging machine comprising sequential manipulating apparatus and/or regulating apparatus.

According to an optional feature of this aspect of the invention, the cartons may be held in a hopper with a side edge thereof orientated downwardly and wherein the carton pick-up device may be arranged to translate said cartons from a substantially vertical position in the hopper to a substantially horizontal position in the paper feed chain.

According to a further optional feature of this aspect of the invention, said carton pick up device is rotatable about a fixed axis in an orbital path.

According to a still further optional feature of this aspect of the invention the packaging machine may further comprise an article loading mechanism and a base panel locking mechanism.

A fourth aspect of the invention provides a controller for a packaging machine the controller comprising a central processor, manual input means, and separate means controlled by the central processor for synchronising the loading of an article grouping into a carton.

According to an optional feature of this aspect of the invention the controller may set the relative positions of three rows of articles at the in-feed end of the packaging machine.

According to a further optional feature of this aspect of the invention the controller may control a motor which drives the carton erecting device.

According to an optional feature of this aspect of the invention the controller may control the motors which drive the carton feed, thereby sychronising the unerected carton flow rate with the erected carton flow rate.

A fifth aspect of the invention provides a method of continuously feeding and setting up a carton having oppositely disposed side and end panels and a pair of base panels from a flat collapsed condition to a position of use, which method comprises the steps of:

(a) sequentially withdrawing a carton stored in a hopper;

(b) transferring the carton to a horizontal plane;

(c) separating the base panels to cause one of the base panels to be engaged by a conveyor;

(d) manipulating the side and end panels into a substantially vertical plane;

(e) separating the opposing side and end panels to erect the carton.

According to an optional feature of this aspect of the invention the method may additionally comprising the steps of:

(f) lowering the cartons onto an article grouping;

(g) locking the base panels of the carton together.

Advantageously, as the present invention provides an in-line machine, the machine may operate with a high throughput as no changes of carton flow direction are required. Furthermore, carton change over may be carried out with a short down time as the pitch of the machine does not require manual adjustment, and downtime is reduced.

BRIEF DESCRIPTION OF THE SEVERAL VIEWS OF THE DRAWINGS

Exemplary embodiments are now provided, by way of example only, with reference to the accompanying drawings in which.

DETAILED DESCRIPTION OF THE INVENTION

The machine according to the preferred embodiment of the present invention is capable of storing, erecting and loading a variety of carton types, for example wrap-around, fully enclosed and basket type cartons with one or more articles, for example bottles or cans. Any reference in this specification to carton type includes different sizes or configurations of any particular carton style, for example fully enclosed cartons for 8 or 12 articles in 4×2 and 4×3 configurations respectively. Indeed, it is envisaged that other carton sizes and configurations could be packaged, by suitable adjustment to the machine, hereinafter described.

Figure 1A:
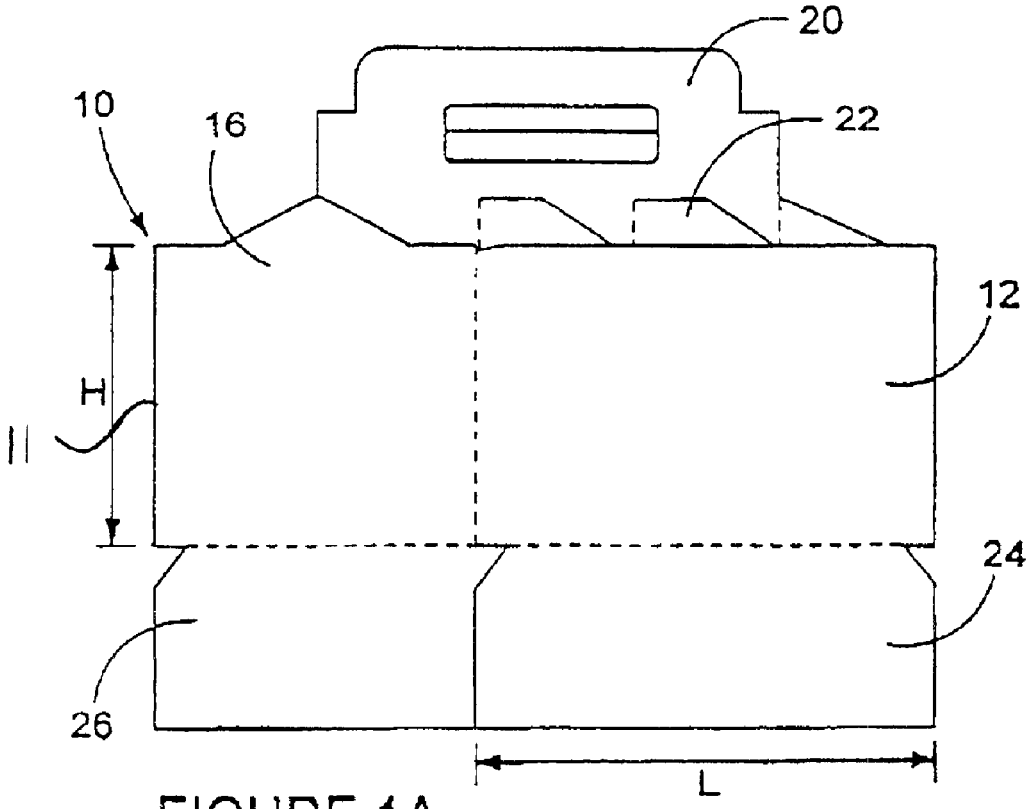
FIG. 1*a* is a side view of an example of a basket type carton supplied in a flat collapsed condition suitable for use with machine accordingly to the invention.
Figure 1B:
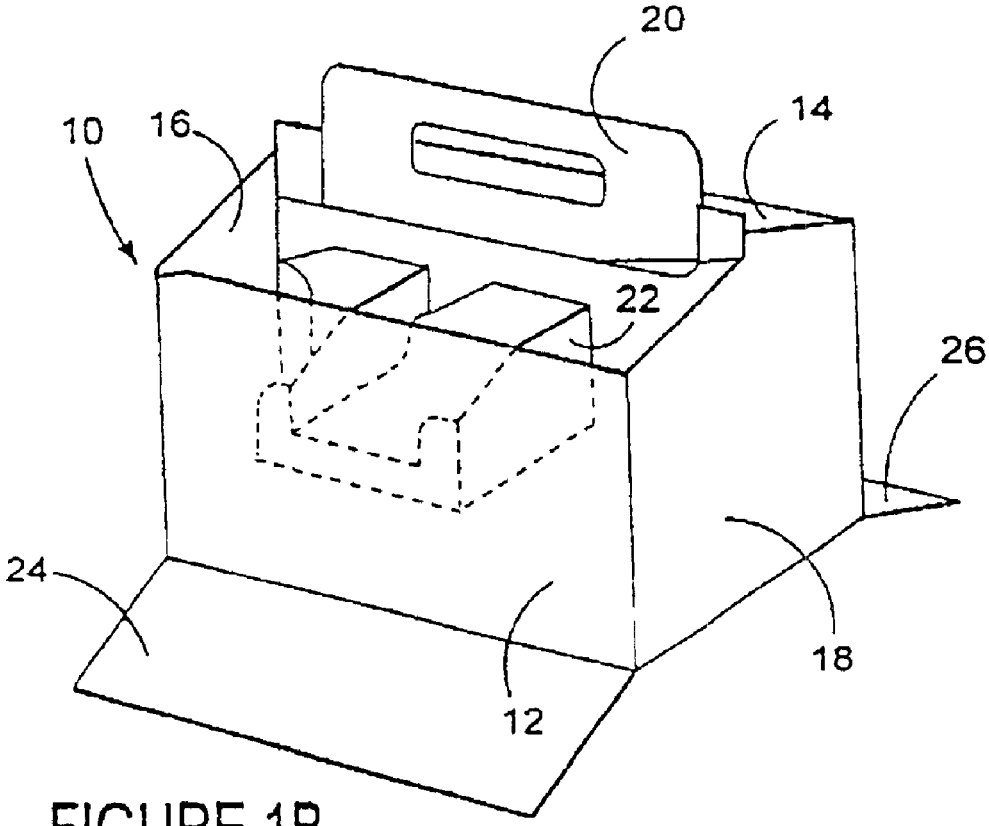
FIG. 1*b* is a perspective view of the basket type carton of FIG. 1 when fully erected.

Referring to the drawings, and in particular FIGS. 1*a* and 1*b* thereof, there is shown one example of the cartons processed by the machine of the present invention. Carton 10 is a basket type carrier shown in FIG. 1*b* in a set-up condition ready for loading onto articles. The carton is made from paperboard or other suitable foldable sheet material. The carton 10 includes opposed side wall panels 12, 14 and opposed end wall panels 16, 18 hingably connected one to the next. The carton may further include a handle structure 20 which interconnects end wall panels 16, 18 and comprises transverse partition panels 22 interconnecting each side wall 12, 14. Preferably, base panels 24, 26 are hingably connected to each side wall panel 12, 14 respectively.

Figure 2:
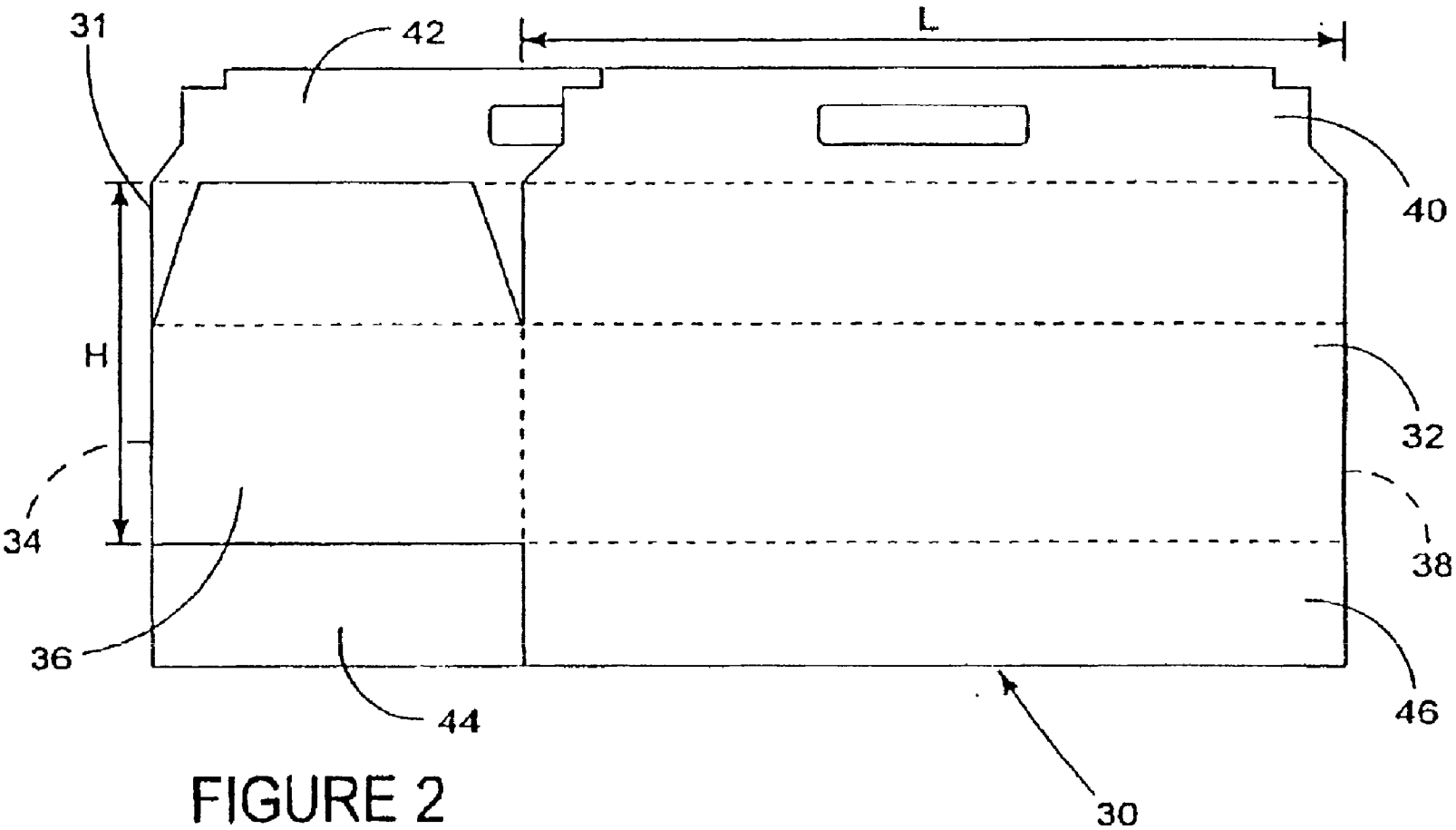
FIG. 2 is a side view of an example of a fully enclosed type carton supplied in a flat collapsed condition suitable for use with the machine according to the invention.

Referring now to FIG. 2 of the drawings, there is shown a second example of a different carton processed by the machine of the present invention. Carton 30 is a fully enclosed carton, shown in its flat collapsed form. The carton blank includes opposed side wall panels 32, 34 and opposed end wall panels 36, 38 hingably connected one to the next. The carton may further comprise top panels 40, 42 and base panels 44, 46 hingably connected to respective side walls 32, 34. The carton may optionally be supplied with an inner vertical partition panel.

It is envisaged that the cartons will vary depending upon the shape or quantity of articles to be packaged and accordingly, the machine of the present invention is adjustable in numerous respects so that it can process a wide variety of such cartons. The principle arrangements which are likely to be varied are shown in FIGS. 1*a* and 2 in which "H" is the overall height of the set-up carton equivalent to the distance between the upper edge of the side wall and base panel, "L" is the overall length of the carton when the base panels have closed. In this embodiment, the machine is adjusted to package cartons, two rows of articles in the case of basket carriers, or two, three, or more rows in the case of fully enclosed cartons Turning to the construction of the machine, the upstream end shown in FIGS. 3 and 4 includes a magazine or hopper in which a multiplicity of basket type or fully enclosed cartons 10, 30 in a collapsed condition are held for processing. The hopper may be either of the gravity feed type, or alternative means known in the art can be used to provide a positive feed. In prior art machines, cartons are stacked on their base wall panel edges. As the fold lines between the base wall panel edges and the side panels are in the same position for both bottom and side panels, this makes the carton stack weaker when in this orientation and more susceptible to buckling, causing feed problems. Beneficially, the present invention allows cartons to be stacked in the magazine with their side edge 11, 31 lowermost, which reduces carton wastage.

Figure 3:
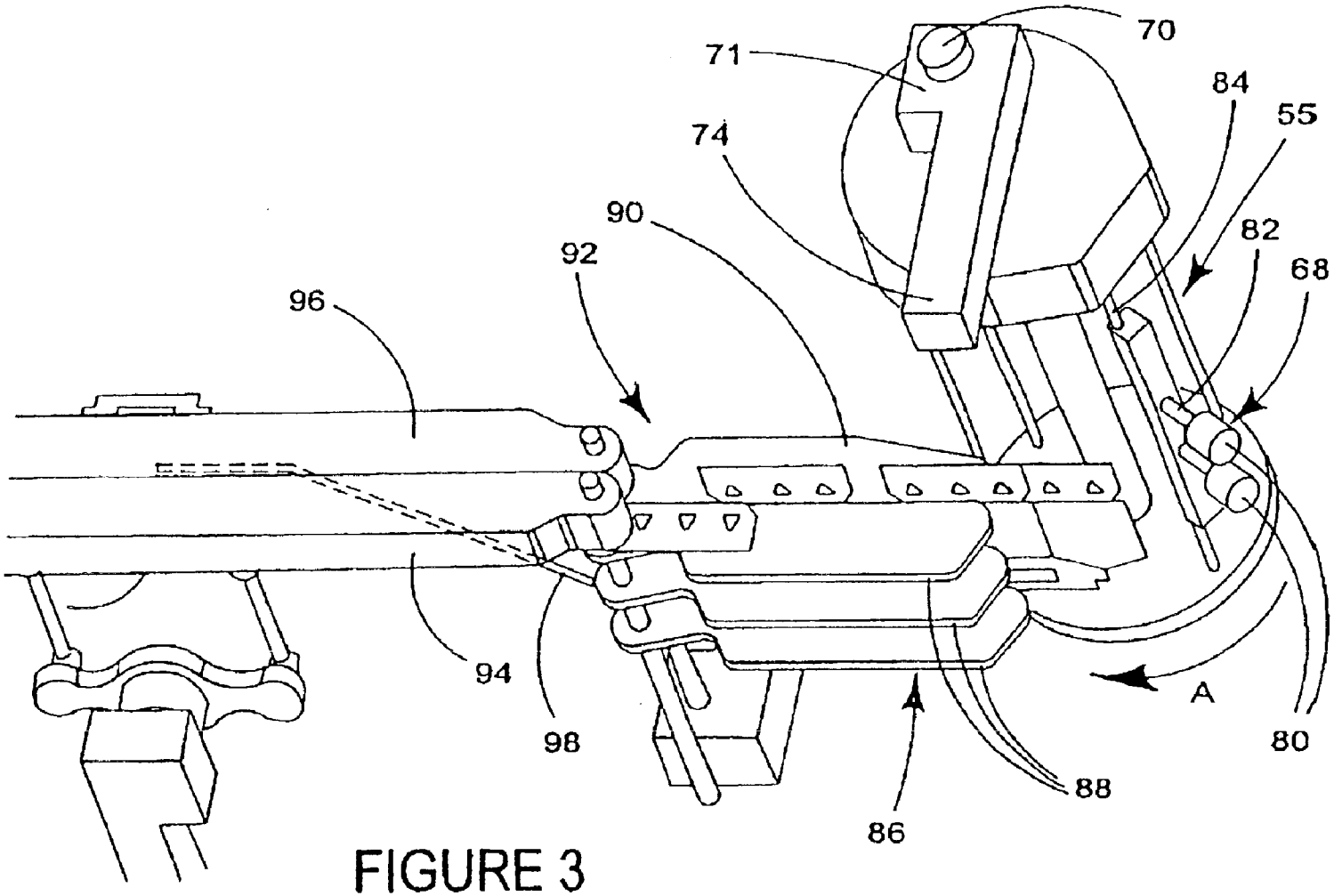
FIG. 3 is a perspective view from below and to one side of the in-feed of a packaging machine illustrating the feed mechanism of a preferred embodiment of the invention.
Figure 4:
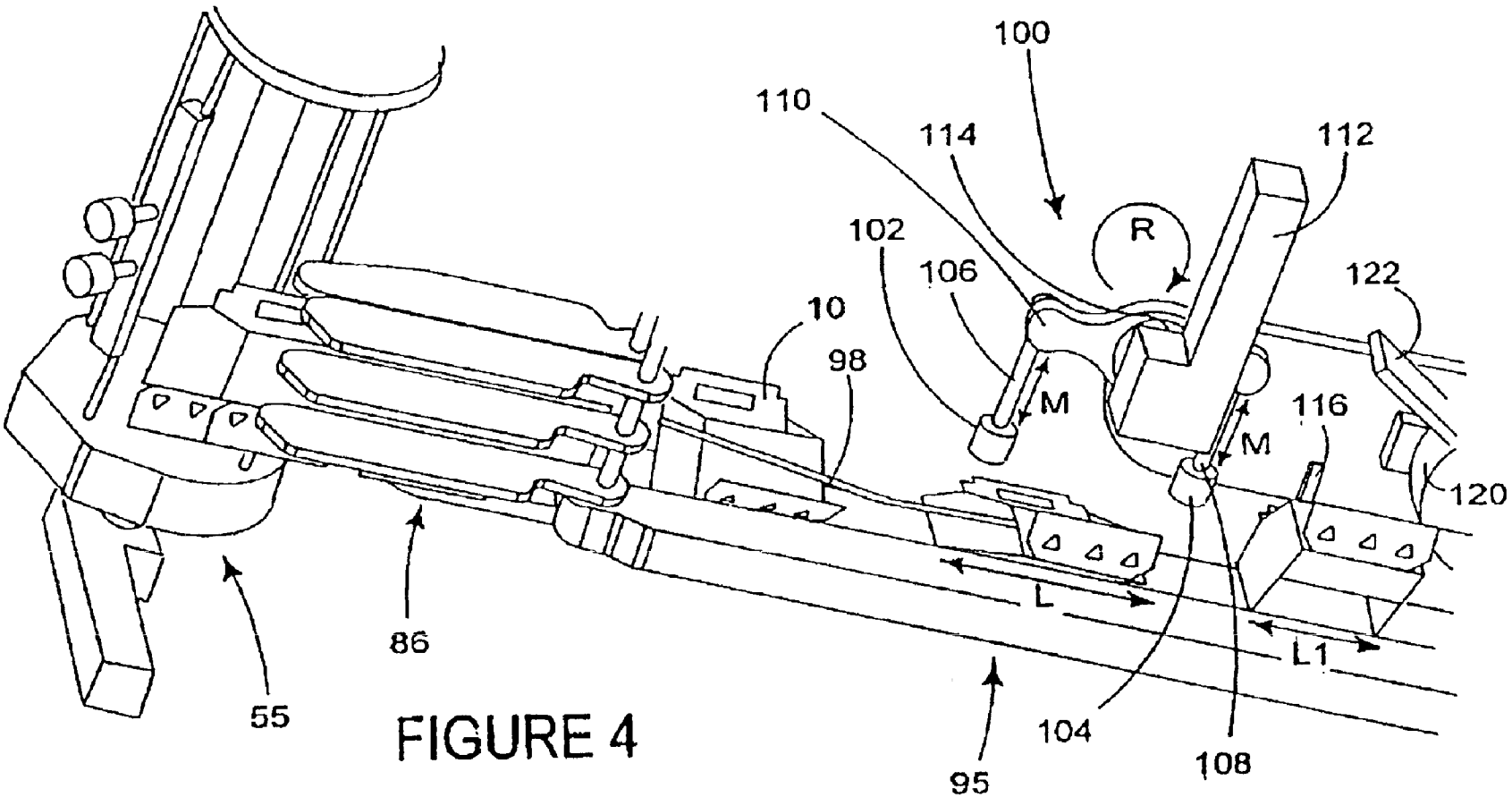
FIG. 4 is a perspective view from below and to the other side of the carton set-up station of a preferred embodiment of the invention.

A rotary feeder is positioned adjacent the hopper illustrated in FIGS. 3 and 4 to transfer cartons from the hopper to the infeed end of the machine. The feeder mechanism according to this invention includes a main shaft 70 rotatable in a substantially horizontal fixed axis. The shaft 70 is generally supported at its end by a suitable bearing structure 71. A suitable driving mechanism such as a servo motor 74, is provided to rotate the shaft 70 which is controlled by the controller described below.

In order to withdraw the end collapsed carton from the hopper unit, a pick up device 68 is provided including carton engaging means, for example suction cups 80, and a frame 82 driven by the shaft about a pre-determined path. In a preferred embodiment, four pick up devices 68 are provided on respective frames and cross bars 84, however, for the sake of clarity only one has been illustrated in FIGS. 3, 4, & 5.

In use, the feeder mechanism 55 continuously and sequentially feeds cartons from the hopper to the infeed end of the machine by rotating the pick-up device 68 in the direction indicated by the arrow A, shown in FIG. 3. As the pick-up device 68 rotates, suction cups 80 are moved in contact with the wall of the carton to be erected. A vacuum is then applied to the set of suction cups by a vacuum supply, as is well known, and the carton is withdrawn and then transferred onto an endless conveyor, shown generally at 86 to move the carton downstream in a continuous forward direction to the set-up station and thereafter onto the loading station.

The rotation of the rotary feeder 55 about a substantially horizontal axis causes the collapsed carton to be translated from a substantially vertical plane in the magazine (not shown) to substantially horizontal plane as it is introduced into the in-feed belt set 86 as shown in FIG. 3.

In this embodiment, the conveyor comprises an in-feed belt set 86 provided by one or more pairs of spaced apart upper and lower receiving belts 88, 90 positioned relative to the hopper, so as to receive the side and end walls of the flat collapsed carton delivered by the rotary feeder 55. The belt sets 88, 90 maintain the transverse position of the carton and move the carton downstream to a folding device. Preferably, the belt sets are controlled by the controller, described below, so that the timing of the blanks at the infeed can be synchronised with other parts of the machine.

The folding device 92 is for folding one of the base panels out of alignment with the flat carton. In this embodiment, the bottom flaps 24, 26; 44, 46 of the carton, however, protrude from the edge of the upper and lower receiving belts and, preferably, the lower flap is longer than the upper flap. Thus, in one embodiment the folding device comprises a fixed guide which engages the lower flap 26; 44 to fold it into a substantially perpendicular relationship with the carton, without folding the uppermost bottom flap 24, 46 as well. Alternatively, a suitable form of mechanical plunger or the like may be used to push or guide the flap to the desired position.

As the carton progresses downstream, the upper bottom flap 24; 46 is engaged by a second conveyor 94, 96. The lower flap 26; 44 is not engaged because it is no longer aligned, as shown in FIG. 4.

Thereafter, suitable guide means 93, for example a fixed guide 98 engages the underside of the still horizontal carton and guides the side and end panels upwardly out of the plane of the upper bottom panel 24; 46 held by the second conveyor 94, 96. The side and handle panels of the carton 32, 34, 40 are then in a substantially vertical plane ready for transferral downstream to the next stage of the erection process, the panel separation process. Preferably, the opposing base flap is folded by suitable guide means out of alignment with the next adjacent side panel.

Figure 5:
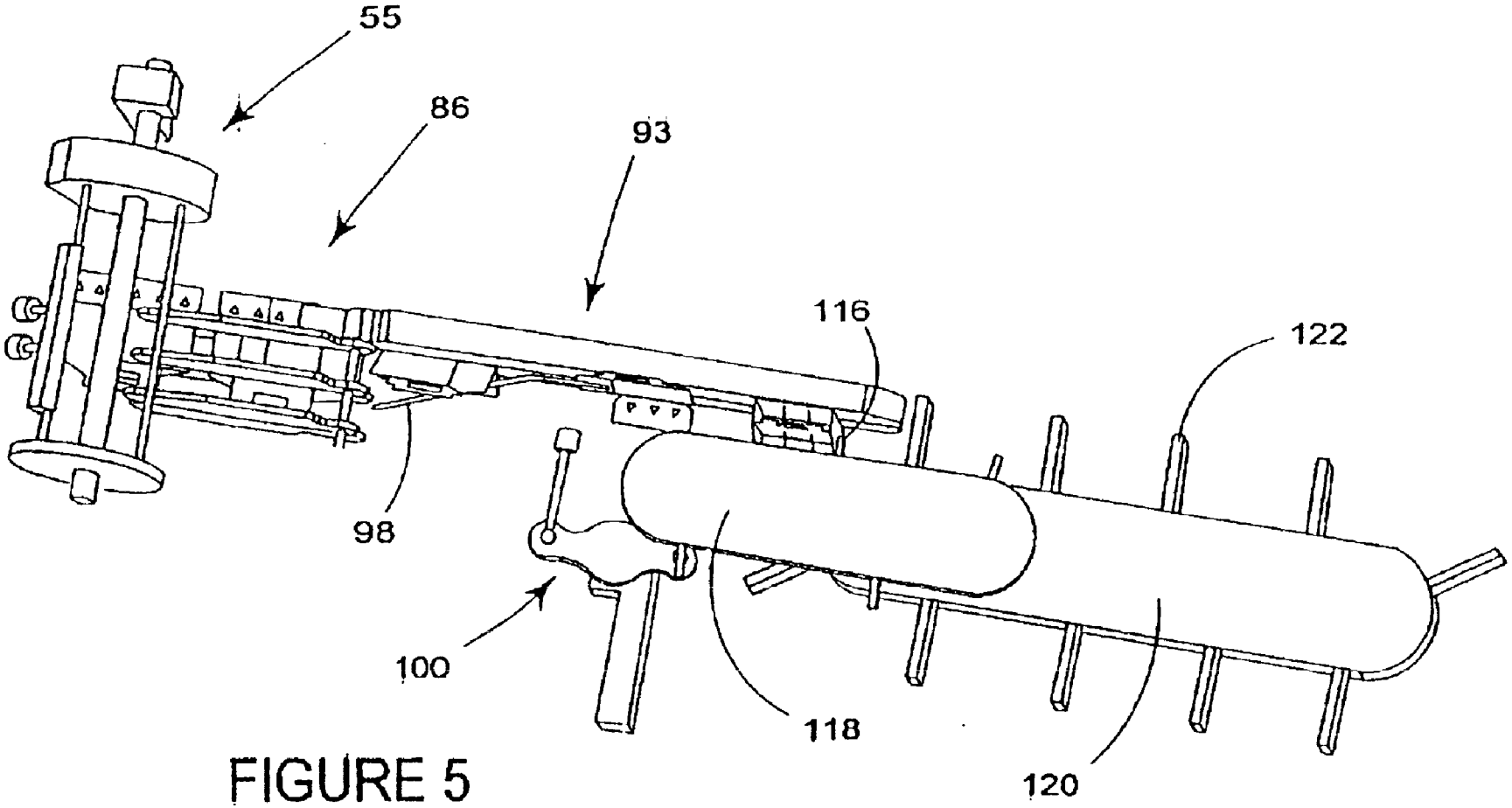
FIG. 5 is a top perspective view of the carton set-up station shown in FIGS. 3 and 4.

FIGS. 4 and 5, illustrate the panel separating device 100 that causes the side and end panels of the carton to be separated. This is achieved by holding one of the bottom flaps 24;26 in conveyor 94, 96 and optionally one side of the carton and pulling the opposing side and end panels away during forward movement by a suitable separating device, for example lugs. In this embodiment, the panel separating device 100 is similar to the mechanism disclosed in pending WO 98/52826, but a single separating means is used whilst one side of the carton progresses at a substantially uniform speed down the second feed belt pair 94, 96 whilst holding the bottom flap 24; 46. The panel separating device 100 comprises one or more vacuum suction cups 102, 104 connected via a drive rod 106, 108 to a drive shaft 110. The drive shaft is preferably driven by a servo motor 112. The drive means is controlled by a controller which can cause the rotational velocity of the panel separating means 100 to vary, and therefore causes the velocity of the suction cup 102, 104 to vary.

The drive rod 106, 108 is preferably connected to a cam track by a cam follower (not shown) contained in a housing 114 or to other suitable means to provide a uniform path for the suction cups when the drive shaft 110 is rotated. Thus, the suction cups and drive rod are moved under a guided linear motion "M" towards and away from the carton during one complete rotation "R" of the drive shaft.

In the present embodiment it is envisaged that a vacuum break is provided in the housing 114 which is used in conjunction with the vacuum supply to set the vacuum connection and cut off points thereby determining when the carton is held by panel separating device 100.

In this way, when the carton 10, 30 advances down the second conveyor 95, the suction cup 102, 104 of the panel separating device 100 is rotated and caused to engage the side panel 14, 34 of the carton and vacuum is applied to the suction cup. During this process the rotational velocity of the suction cup may need to be increased to marry with the carton forward velocity, so that it can engage the carton properly.

The panel separating means 100 is then caused to decrease its rotational velocity by the controller so that the forward path suction cup 102, 104 is decelerated relative to the moving carton blank to start the panel separation process. Thereafter, the suction cup 102, 104 is also caused to move away from the carton by the cam effect of the device so that the side panel 14, 34 and leading end panel 18, 38 are separated and moved apart from the other side panel.

The preferred point of contact between the panel separating means 100 and respective panels 12, 32 is in a central portion of the wall being separated however, the position will vary according to the type of carton and in particular the dimensional variations of the side end walls for each carton type and four different carton sizes. It is envisaged that the acceleration and/or deceleration can be altered according to the type of carton being processed through the machine and throughput machines required are including manual input capability in the controller. Of course the controller may be a dedicated process or may be a controller for a packaging machine with which the apparatus of the invention is used. Alternatively, the control means may preferably be a programmable servo control system.

Figure 6:
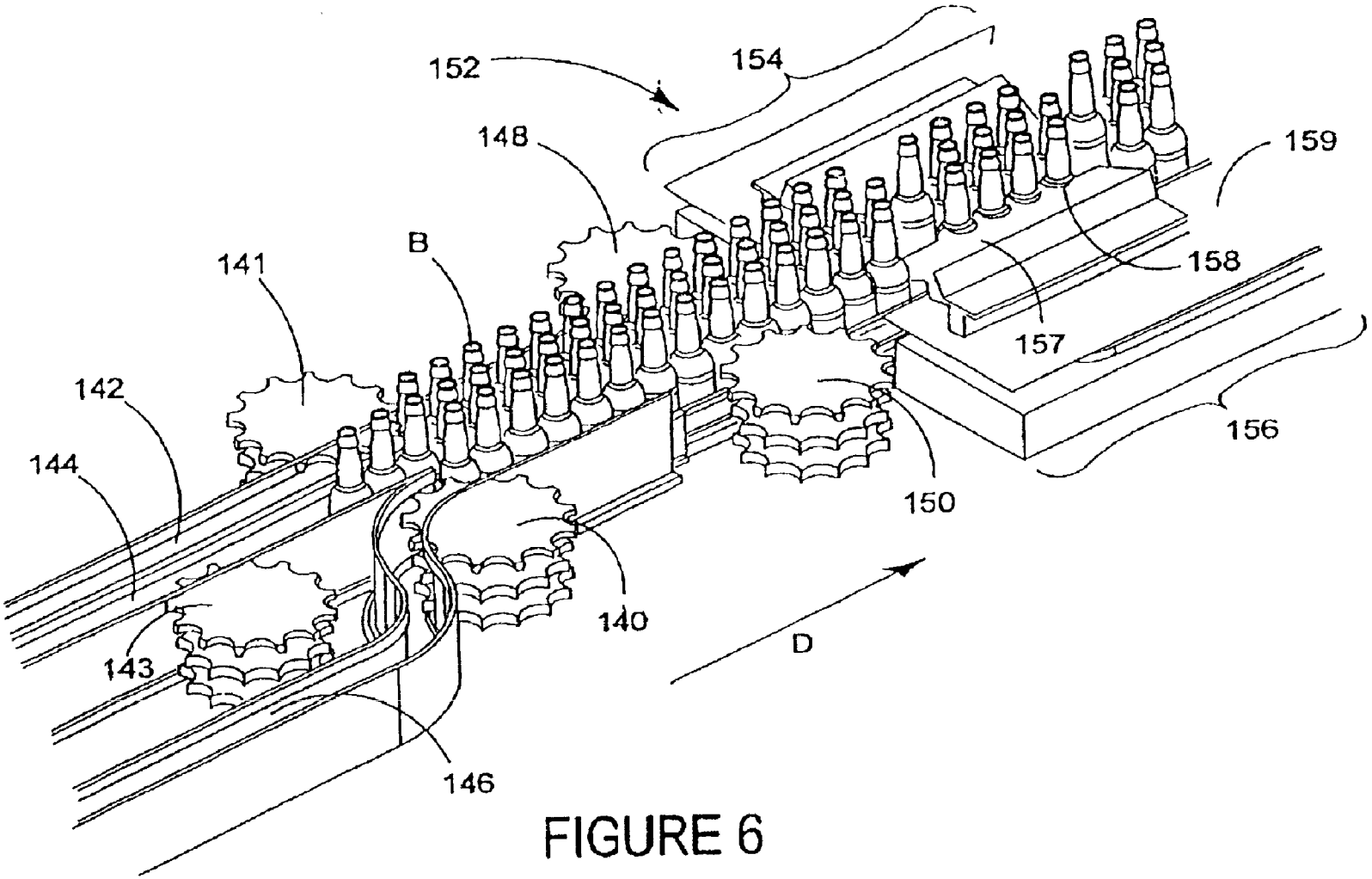
FIG. 6 is a perspective view illustrating the article grouping mechanism of a preferred embodiment of the present invention.

Turning now in particular to FIGS. 5 and 6, the end panels 16, 18, 36, 38 are maintained in a perpendicular relationship to the side panels 12, 14, 32, 34 by lugs 116 mounted on an intermediate conveyor 118. Preferably, the lugs 116 engage the leading edge of the carton to maintain the carton in its partially erected state. The intermediate conveyor 118 runs at the same speed as the cartons on the second feed belt 95. The carton progresses downstream until it engages a blocking lug 122 on main conveyor 120.

Due to the panel separation process, the overall carton length "L" is reduced to L1 shown in FIG. 4. Therefore, in order to maintain the same carton feed rate, and same pitch between the cartons, the main conveyor 120 runs at a lower speed than the second feed belts 93 and intermediate conveyor 118. To ensure that the perpendicular relationship between the end and side panels is maintained, the main conveyor 120 preferably comprises adjustable means (not shown) to hold both end panels of the carton. This may be an additional conveyor mounted adjacent the main conveyor 120, in which the lugs 122 have the same pitch.

Drive means, for example, a servo motor can be controlled independently of the main conveyor by a controller such that the pitch between the lugs 122 on the main and additional conveyor may be adjusted for different carton sizes by reducing the effective spacing between the lugs on the main and additional conveyors. The functioning of the controller is discussed in more detail below.

Figure 8:
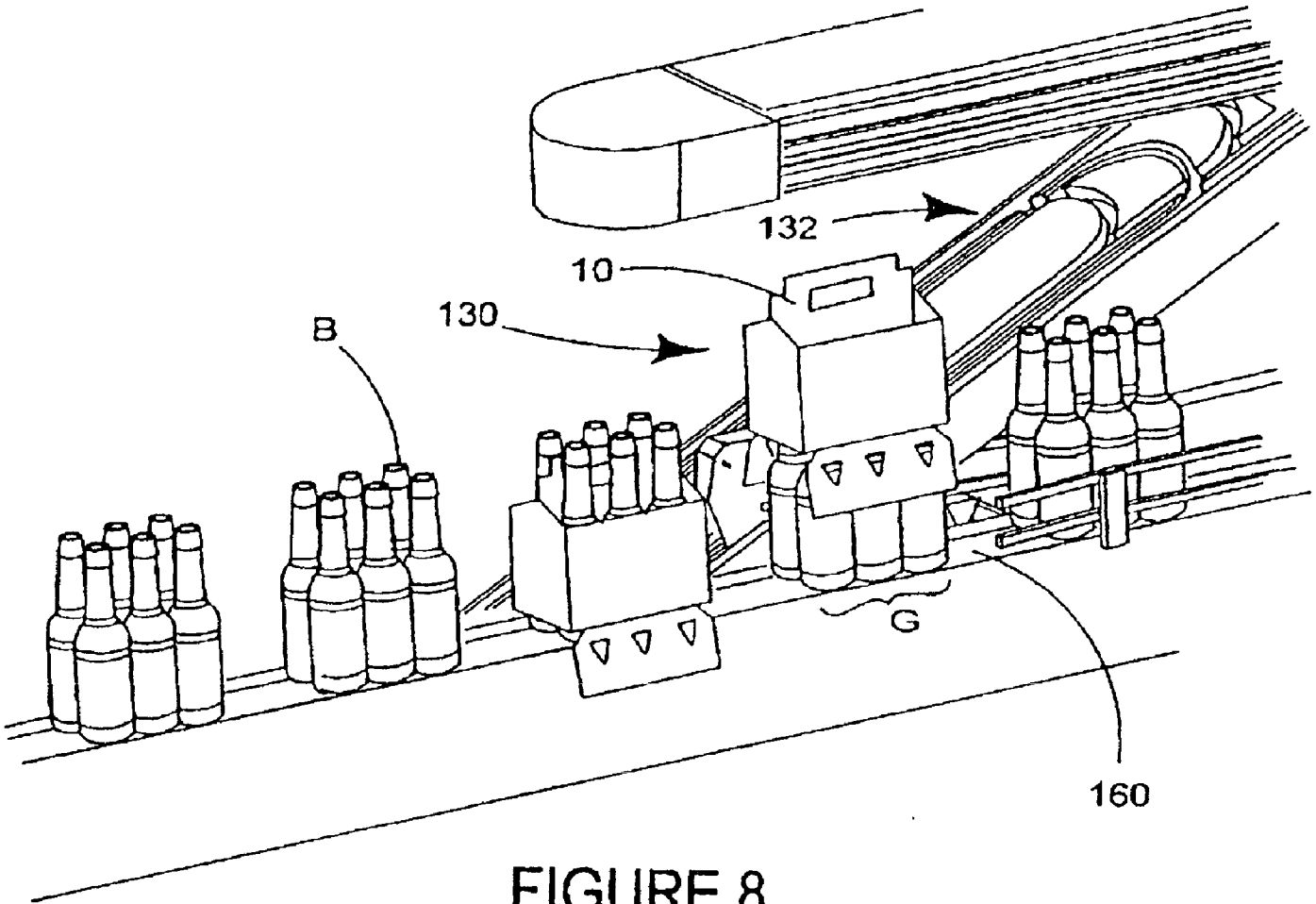
FIG. 8 is a perspective view illustrating the carton loading station of the preferred embodiment of the present invention.

After the cartons have been set-up they are transferred to the loading station 130 shown in FIG. 8. Thus the cartons leave engagement with the main conveyor 120 and engagement is gradually transferred as the cartons move downstream to a carton-lowering device 132 shown in FIG. 8. The main conveyor runs at the same forward velocity as the lowering device 132 so that the transfer may be achieved. For the sake of clarity only one of the lowering devices 132 is shown. The loading mechanism will be described in more detail below.

Figure 7:
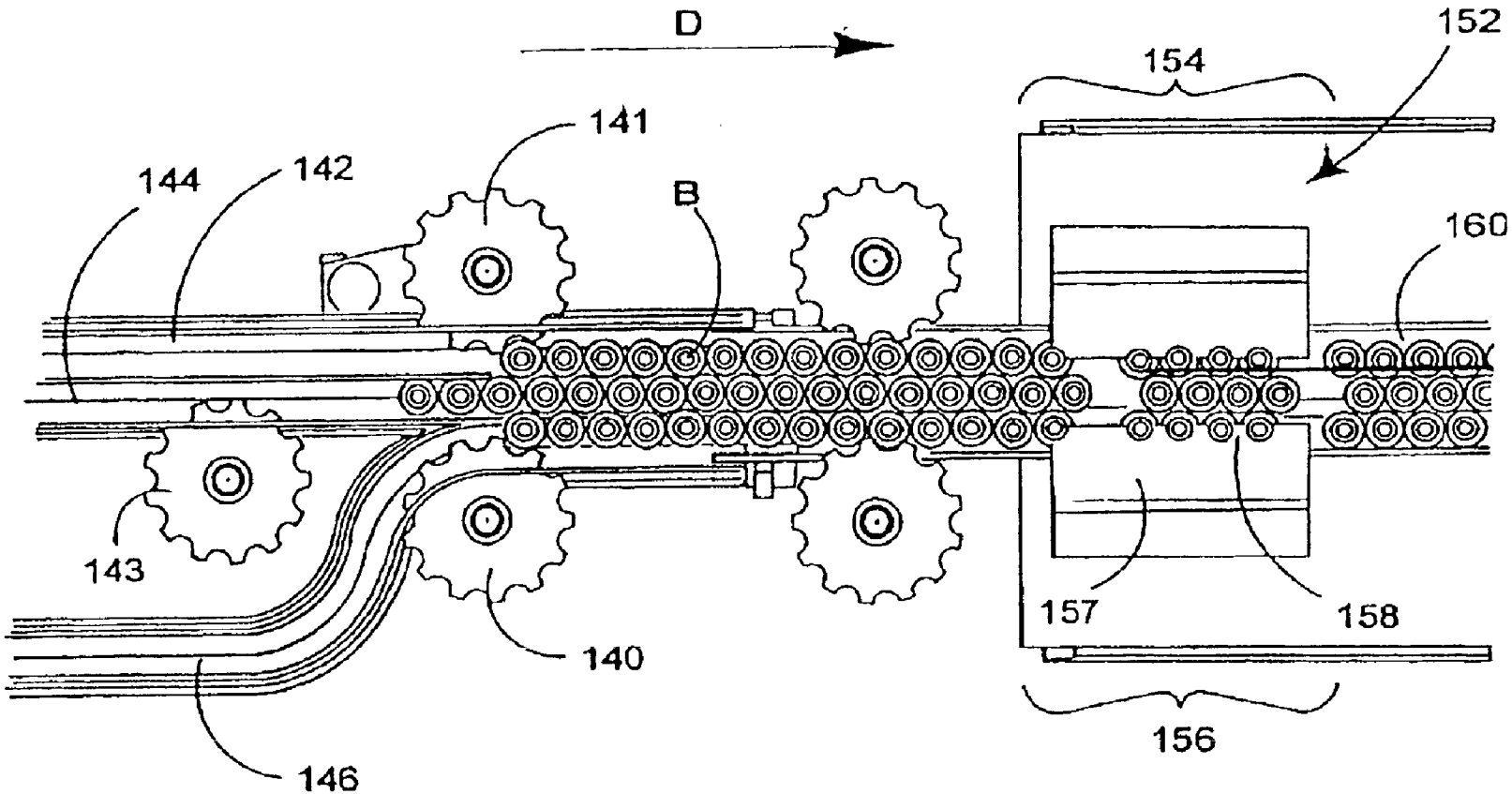
FIG. 7 is a plan view of the article grouping mechanism shown in FIG. 6.

Turning now to the article feeding and grouping mechanism as illustrated in FIGS. 6 and 7. Articles, such as bottles B or cans, are fed into the machine by a conveyor, for example, an endless belt in direction D. In this embodiment, three conveyors are provided, each conveyor moving one continuous row of articles 142, 144, 146. The separate rows converge at one point and progress into the article grouping station 152.

Each row of articles is independently controllable by suitable feed devices. In this embodiment, each device comprises in-feed star wheels 140, 141, 143: that each control the in-feed line pressure, as well as the relative position of the articles in the three rows 142, 144, 146 as they converge. In normal circumstances, the central row of articles will converge half an article diameter off-set from the outer rows, forming an "arrowhead" configuration, so that the two outer bottles push the central bottle forward, thereby providing a positive feed for all articles, which improves the control of the articles. This is clearly illustrated in FIG. 7. For this to be achieved, the central row star wheel 143 preferably provides the reference by which the relative rotation of the outer star wheels 140, 141 is set, using the controller. A further advantage of this configuration is that the central star wheel 143 provides a positive feed to the central row of articles which is not the case with prior art feed arrangements.

Once the three streams are brought together two further star wheels 148, 150 engage the outer articles and control the flow of articles into the grouping station 152, thus ensuring that the correct number of articles enters the grouping station. The grouping station 152 groups the correct number of articles per carton by using a series of article grouping assemblies 154, 156. These assemblies 154, 156 also control the flow of the articles which in turn are controlled by the controller so that they can be introduced to the carton at the loading station at the same rate as the carton flow. The grouped articles are moved to the loading station 130 by means of an article conveyor 160 shown in FIG. 7. The feed devices are driven by drive means, for example servo motors, controlled by a suitable controller so that the article feed rate of each row can be adjusted by changing the rotational velocity of the star wheels 140, 141, 143. Furthermore, the feed rate of an article group into the grouping device can be adjusted by changing the velocity of the star wheels 148, 150 controlled by the control means.

The construction of the grouping station outlined above will now be described with reference to FIGS. 6 and 7 in particular, and is substantially similar to the grouping station disclosed in pending PCT application PCT/US98/19651. In this embodiment a grouping assembly 154, 156 is positioned on each side of the article conveyor 160. Both of the grouping assemblies 154, 156 are identical in construction, and therefore, only the nearside assembly 156 is in detail. The assembly 156 includes two spacer elements 157 with one or more article recesses 158 mounted onto a track (not shown) for reciprocal movement parallel to the flow direction of the bottles.

The assembly is driven by a drive means, for example, a servo motor to drive the spacer element 157 along a path in a plane parallel to the article conveyor 160. This arrangement allows the spacer element 157 to be moved laterally to assist in the smooth engagement and disengagement of the articles B in the recesses 158.

The grouping mechanism is able to process cartons comprising numerous configurations of groups of articles covering a range of carton sizes and shapes without undue time being spent in adjusting the mechanism. The grouping station 152 and star wheels may be mounted onto platforms which are movable in a direction perpendicular to the direction of flow of the articles such that the assembly may be adjusted to feed groupings with either two or three rows of bottles. If the grouping station is moved down to two row operation, one of the outer star wheels, preferably star wheel 140 ceases to operate, and the relative positions of the articles fed through the two remaining rows is adjusted so the bottles are no longer off-set.

The present invention also provides for adjustment to the number of articles per row by controlling the number of articles into the grouping station 152 by the controller. It is envisaged that one or more rows of one, two, or three articles can be selected by utilising a corresponding number of recesses 158. If it is desired to increase the number of articles to five or more per row, then the endless chainset of this embodiment can be interchanged with another chainset comprising spacer elements with more recesses.

The articles gradually leave contact with the grouping station 152 and are transferred to the loading station 130 by the article conveyor 160. At the loading station 130, which is substantially similar to that disclosed in PCT/US98/19619 as illustrated in FIG. 8, the cartons are introduced to a group of articles from above as the carton 10, 30 and article group G are moved forward continuously in unison. The carton is lowered onto the group G by the downward incline of the endless chainsets 132. If groupings comprising three rows of articles are to be loaded into the carton, a change from the "arrowhead" configuration is achieved when the end panels of the descending carton come into contact with leading and trailing articles, so that the panels guide the bottles into lateral and longitudinal alignment as they are loaded into the carton. Of course, it is envisaged that the configuration adopted depends upon the type of carton being loaded.

Once the cartons have been loaded with articles, they are transferred by means of the article conveyor and/or pressure belt to a further set of endless chains with side lugs which are used to transfer the carton to the out-feed end of the machine. During this stage, the bottom flaps are folded around to the underside of the carton, and are interconnected by a suitable locking mechanism known in the art.

Suitable means is provided to control the function of the modular elements and the overall functioning of the machine, thus ensuring that the correct number of articles are supplied to the loading station and that the correct number of cartons are supplied to the loading station in synchronism with the article supply.

In response to a user input or a signal from an upstream machine in the packaging plant of the desired carton output of the machine, the controller will set the rotational velocity of the second star wheels 148, 150. In order to ensure that sufficient articles are supplied to the second star wheels and that the relative positions of the bottles in the rows is correct, the three infeed star wheels 140, 141, 143 are individually controlled, with the feed of the two outer wheels 140, 141 being controlled relative to the centre wheel 143.

The spacer elements 157 are further individually controlled, the frequency of engagement with an article grouping being determined by the rate of article infeed in order to form article groupings containing the correct number of articles.

The required carton feed is determined as a function of the rate of article infeed, and the number of articles per carton. The angular velocity of the rotary feeder is determined in response to this. As the cartons progress towards the panel separating device 100, the position of each carton is determined. In one class of embodiments, a sensor is provided to detect the carton position. This information is supplied to the controller associated with the panel-separating device, and triggers the operation of the suction cups. The controller is also supplied information about the velocity of the second conveyor 95, thus enabling the angular velocity of the separating means to be adjusted to separate the panels correctly, as described above.

The partially erected carton is then transferred by intermediate and main conveyors 118, 120 to downwardly inclined chainsets 132. The carton pitch of these chainsets is fixed for a particular carton size, and can be adjusted for different sizes of carton. Therefore, in order for the cartons to be synchronised with the article groupings the drive velocity must be adjusted up or down accordingly. Sensing means which detects the position of the article grouping and the velocity of the article conveyor provides the data required to determine and if necessary adjust the velocity of the drive means (e.g. a servo motor) for the inclined conveyor 132 such that the loading is synchronised. Due to the shorter length of the cartons with the panels separated, the intermediate conveyor 118 runs faster than the main conveyor in order to maintain continuity of flow rate between the intermediate conveyor and the main conveyor 120. This speed differential is determined by the controller.

Depending upon carton type, other mechanisms may be employed to complete the setup process. Basket carriers generally require a wheel with projecting lugs (not shown) to apply pressure to the handle panel prior to the folding under of the bottom flaps. The controller moves the pressure wheel to an operative position for basket carriers only, and furthermore, ensures that the lugs engage the correct portion of the handle panel.

Likewise, a belt (not shown) is generally applied to the top of fully enclosed cartons in order to apply downward pressure. The controller ensures this is only used for the correct carton types, and that the belt is running at the same velocity as the bottom belt 160.

The controller preferably additionally controls the locking mechanism (not shown), ensuring that the plungers punching through the tabs are synchronised with the carton flow. When the carton has different sized bottom flaps, and the locking tabs are therefore off-centre, the control means is able to move the locking mechanism to be aligned with the locks on the carton.

The controller may further include a feedback mechanism such that if a fault develops in the packaging process, the machine is automatically shut down. Furthermore, if the maximum running speed of one module is reached, the remainder of the machine is prevented from oversupplying this module.

During the initial start up process, the driver mechanisms (e.g. star wheels, conveyors) will gradually increase in speed until the desired running speed is reached. All of these apparatuses will be controlled such that this process will be gradual and no damage will occur to the articles or cartons.

The controller is preferably a microprocessor, which is capable, via a suitable interface, of controlling each individual servo motor driving the various mechanisms.

Figure 9:
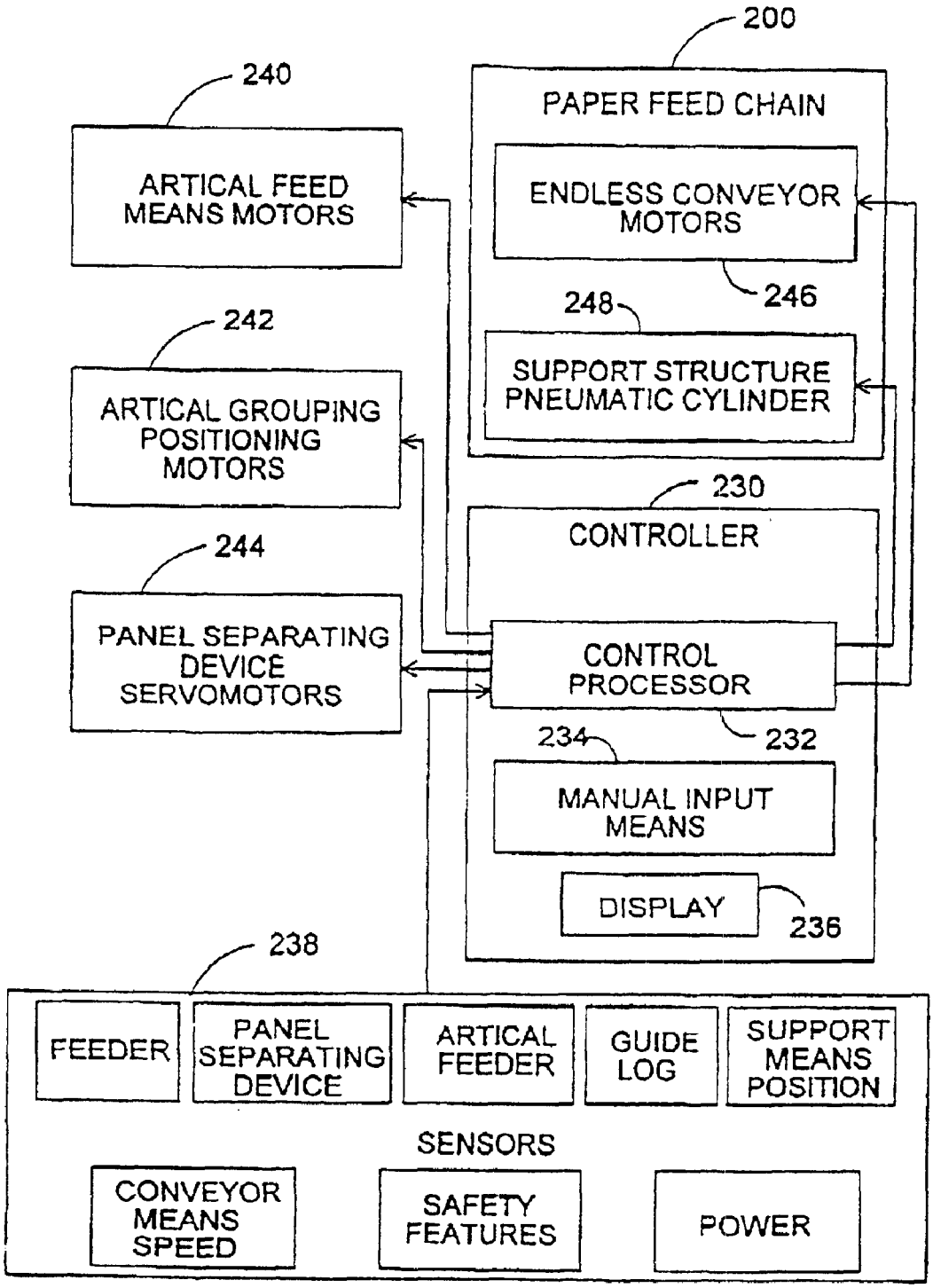
FIG. 9 is a block diagram of one example of the controller.

FIG. 9 is a block circuit diagram illustrating one example of the electrical and electronic control of the packing machine.

FIG. 9 illustrates a controller 230 having a central processor 232, a manual input means 234 through which specific instructions can be programmed, and a display 236 which indicates useful information to the machine operator. The central processor 232 and the display 236 can display operational information, such as the speed of operation of the machine and its compliance with particular safety requirements, in the normal manner. In addition, the central processor 232 and display 236 can also indicate information specific to the present machine, such as the position of the guide lugs 122 and 116 and the position of the feeder 55 and the panel-separating device 100. All of this information is provided through sensors shown generally at 238.

As discussed above, the controller 230 also controls the positions of the moveable components as well as the speed of movement of variable speed components. For example, the central processor 232 controls the motors 240 which power the feed means (drive conveyor, star wheel and grouping mechanism) which move articles to be packed into (the infeed end of) the machine.

The processor 232 also controls the position of the panel-separating device 100 through programmed and accurate control of X and Y servo motors 244. In addition, the central processor 232 also controls the paper feed chain 200 through control either or both of the servo motors 146 which control the endless conveyors from which the guide lugs 116 and 122 are depended, as well as the pneumatic cylinder 248 which controls the position of the support structure (not shown) and the article grouping positioning motor 242 to switch the grouping between two and three lanes.

Suitable control means can be included to position the support tables of the carton loading module at the desired location for a particular carton type or size by controlling the pneumatic cylinder and/or the hydraulically powered columns (not shown). The controller may also control the motors driving each of the endless conveyors to control and adjust the speed and to synchronize carton throughput according to the carton type and/or size.

Additionally, the controller 230 may control the wraparound carton feeding and loading apparatus to place the apparatus in operative or inoperative conditions, as described above.

As will be discussed below the positions and speed of these devices can be input manually or a specific pre-written program can be loaded into the central processor for control of the packaging machine. Also, for the controlled change over of the machine from one carton type or size to another can be the result of a pre-written program or a manual input signal.

Modifications may be made without departing from the scope of the present invention. In particular, alternate sensors and alternate means of positioning each of the moveable articles may be utilised without departing from the scope of the invention as claimed in the accompanying claims.

Alternatively, each module of the packaging machine may have an individual controller. In order that the machine may function correctly, the individual controllers are capable of interfacing with each other to share data.

By pre-programming the control system, the adjustments to the machine required to change from packaging one carton type to another carton type can be pre-set, thus reducing the amount of downtime when interchanging carton types or styles. According to this invention, the speed of operation of the apparatus is improved as well as its efficiency and durability. An advantage of the present invention is the flexibility offered by the system.

Advantageously, the controller 230 ensures that the machine operates efficiently and reliably with a minimal amount of stoppages due to operational errors, and that the machine can be adjusted rapidly to accommodate differing carton sizes and types, and different article groupings. Furthermore, it should be understood that change over between cartons is preferably achieved almost entirely automatically, if the controller has been pre-programmed to do so, the only necessary major manual adjustment being the replacement of the cartons in the hopper.

While the preferred embodiment described herein is for loading bottles into cartons, it will be recognised that the invention is not limited to cartons for bottles. The invention may be used with machines for packaging cans, paperboard 'bricks', bottles and other containers into cartons.

Further, the various elements of the machine, for example carton manipulating apparatus, folding apparatus, set up station or loading station can be manufactured separately as a module to be incorporated into new machines or supplied on a retrofit basis without departing from the scope of invention.

Moreover while the preferred embodiment described herein shows as part of the machines for loading containers to keep two types of carton the invention is not limited to cartons of this type, as will be recognised by those skilled in the art the invention may be used with both wraparound and unloading cartons or where it is desired to manipulate cartons through any desired angle of rotation.

It will be understood that the carton erecting mechanism and manipulating mechanism of the invention has been illustrated with reference to a specific embodiment and that numerous modifications are possible within the scope of the invention. The carton erecting mechanism is able to process cartons comprising numerous configurations of groups of articles covering a range of carton size and shape, without undue time being spent in adjusting the mechanism.

What is claimed is:

1. An apparatus for sequentially manipulating out of a hopper and initiating set up of collapsed cartons having oppositely disposed side and end panels and a first base panel and a second base panel, said apparatus comprising a carton pick up device for sequentially engaging one of said opposed panels and for withdrawing from the hopper a collapsed carton oriented in a substantially vertical plane, a feeder for translating the carton from the substantially vertical plane to a substantially horizontal plane and transferring said carton from said hopper to an in-feed end of a packaging machine, a separator to misalign the first base panel from the carton to a substantially vertical plane to separate the base panels so that the second base panel is engaged by a conveyor and held in a substantially horizontal plane and the first base panel remains unengaged by a conveyor, a guide to manipulate or to guide the side and end panels from said substantially horizontal plane into a substantially vertical plane and said first base panel from said vertical plane to a substantially horizontal plane while said second base panel is held by said conveyor, and a carton erecting device to pull the opposing side and end panels away from the base panel held in the conveyor to erect the carton.

2. The apparatus according to claim 1 wherein the feeder is a rotary feeder having the carton pick up device mounted thereon.

3. The apparatus according to claim 1 wherein the separator comprises a fixed guide that engages one of said base panels and folds it out of the plane of the carton.

4. The apparatus according to claim 3 wherein the guide is a second fixed guide.

5. The apparatus according to claim 1 wherein the carton erecting device comprises a vacuum suction cup rotatably mounted on a drive shaft such that the suction cup may move under guided linear motion towards and away from the carton during one complete rotation of the drive shaft.

6. A packaging machine including an apparatus for sequentially manipulating out of a hopper and initiating set up of collapsed cartons having oppositely disposed side and end panels and a first base panel and a second base panel, said apparatus comprising a carton pick up device for sequentially engaging one of said opposed panels and for withdrawing from the hopper a collapsed carton oriented in a substantially vertical plane, a feeder for translating the carton from the substantially vertical plane to a substantially horizontal plane and transferring said carton from said hopper to an in-feed end of a packaging machine, a separator to misalign the first base panel from the carton to a substantially vertical plane to separate the base panels so that the second base panel is engaged by a conveyor and held in a substantially horizontal plane and the first base panel remains unengaged by a conveyor, a guide to manipulate or to guide the side and end panels from said substantially horizontal plane into a substantially vertical plane and said first base panel from said vertical plane to a substantially horizontal plane while said second base panel is held by said conveyor, and a carton erecting device to pull the opposing side and end panels away from the base panel held in the conveyor to erect the carton.

7. A packaging machine according to claim 6 wherein the cartons are held in a hopper with a side edge thereof orientated downwardly and wherein the carton pick-up device is arranged to translate said cartons from a substantially vertical position in the hopper to a substantially horizontal position in the paper feed chain.

8. A packaging machine according to claim 7 wherein said carton pick up device is rotatable about a fixed axis in an orbital path.

9. A packaging machine according to claim 6 which further comprises an article loading mechanism and a base panel locking mechanism.

10. The packaging machine according to claim 6, further comprising a programmable controller, the controller comprising a central processor, manual input means, and separate means controlled by the central processor for synchronizing the loading of an article grouping into a carton.

11. The packaging machine according to claim 10, wherein the controller sets the relative position of three rows of articles at the in-feed end of the packaging machine.

12. The packaging machine according to claim 10 wherein the controller controls a motor which drives the carton-erecting device.

13. The packaging machine according to claim 10 wherein the controller controls the motors which drive the carton feed, thereby synchronizing the unerected carton flow rate with the erected carton flow rate.

14. A method of continuously feeding and setting up a carton having oppositely disposed side and end panels and a pair of base panels from a flat collapsed to a position of use, which method comprises the steps of:

(a) sequentially withdrawing a carton stored in a hopper in a substantially vertical position;

(b) transferring the carton to a horizontal plane;

(c) separating the base panels to cause one of the base panels to be engaged by a conveyor and the other panel to remain free for rotation;

(d) manipulating the aide and end panels into a substantially vertical plane;

(e) separating the opposing side and end panels to erect the carton as said engaged panel remains engaged by said conveyor.

15. A method according to claim 14 additionally comprising the steps of:

(f) lowering the cartons onto an article grouping;

(g) locking the base panels of the carton together.

16. The apparatus of claim 1 wherein the other of said base panels remains unengaged by said conveyor when separating said base panels from one another.

* * * * *